United States Patent [19]

Berndt

[11] Patent Number: 4,704,821

[45] Date of Patent: Nov. 10, 1987

[54] COMPRESSION SEALS IN A DOUBLE HUNG STYLE WINDOW

[76] Inventor: Lawrence Berndt, P.O. Box 211, Harrington Rd., Cornish, N.H.

[21] Appl. No.: 881,912

[22] Filed: Jul. 3, 1986

[51] Int. Cl.[4] ..... E05F 1/00; E05D 15/10

[52] U.S. Cl. ..... 49/446; 49/209; 49/406

[58] Field of Search ..... 49/445, 446, 406, 209

[56] References Cited

U.S. PATENT DOCUMENTS

| | | | |
|---|---|---|---|
| 2,108,000 | 2/1938 | Holt et al. | 49/406 X |
| 2,761,173 | 9/1956 | Dinsmore | 49/445 X |
| 3,499,248 | 3/1970 | Baer | 49/446 X |
| 4,078,336 | 3/1978 | Prosser | 49/445 |
| 4,464,864 | 8/1984 | Yackiw | 49/406 X |
| 4,503,641 | 3/1985 | Swan | 49/445 |
| 4,580,366 | 4/1986 | Hardy | 49/406 |

*Primary Examiner*—Philip C. Kannan
*Attorney, Agent, or Firm*—Henry C. Nields

[57] ABSTRACT

A double-hung window includes a lower sash and balances having components which cooperate with weatherstripping on the window frame and other components to provide a compression seal when the window is closed.

4 Claims, 9 Drawing Figures

40
37
34
35
36
47
38
39
42
43
31
44
45
30
41
32
48
33
46
4
52
53
54
49
50
51

COMPRESSION SEALS IN A DOUBLE HUNG STYLE WINDOW

BACKGROUND OF THE INVENTION

1. Field of the Invention

This invention relates to windows of the so-called double-hung type, which are characterized by a frame enclosing two sashes, either or both of which are capable of vertical movement so as to open and close the window. If only the lower sash is movable, the window is strictly speaking a single-hung window. However, the term "double-hung window" usually includes such a window also. Since movement is vertical, some sort of counter weight or balance is required in conjunction with the movable sash or sashes.

2. Description of the Prior Art

The double-hung window is probably the most common of the various window types. However, because of the relatively simple technique employed for movement of the sashes, such windows rely on friction for weather tightness when the window is closed. Representative U.S. patents relating to double-hung windows include U.S. Pat. Nos. 4,503,641 to Swan; 4,570,382 to Suess; and 4,580,366 to Hardy.

SUMMARY OF THE INVENTION

The present invention comprehends a window of the double-hung type wherein at least one of the sashes operates. The construction of the window of the invention includes mechanisms which provide a very tight compression seal when the window is closed and locked. The compression seal is accomplished by lateral movement of the sash against weather seals. In a preferred embodiment of the invention, a standard block-and-tackle spring balance is modified by riveting thereto a shoe adapted to provide lateral movement when the window is closed. However, my invention is not limited to such a block-and-tackle spring balance, but includes use of any sort of counter weight or balance, including (but not limited to) spring balances, friction balances, reel balances, rope-and-pulley balances, etc. Also, a fixture which includes a bolt mechanism for fixing the position of the balance when the sash is removed to facilitate cleaning. Each of the shoe fixtures and bolt fixtures include a stud on which the sash is removably supported.

DESCRIPTION OF THE PREFERRED EMBODIMENT

Figure 2:
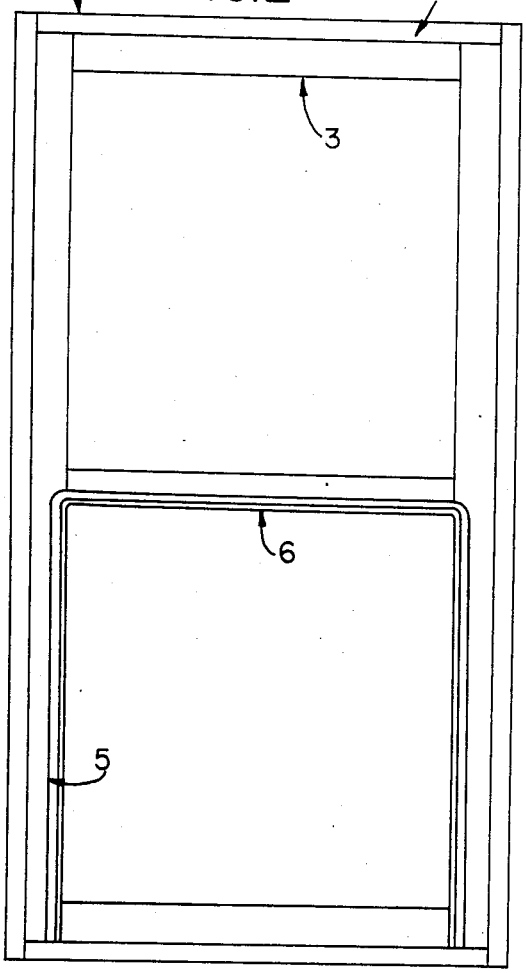
FIG. 2 is a view similar to that of FIG. 1 with the lower or movable sash removed.
Figure 1:
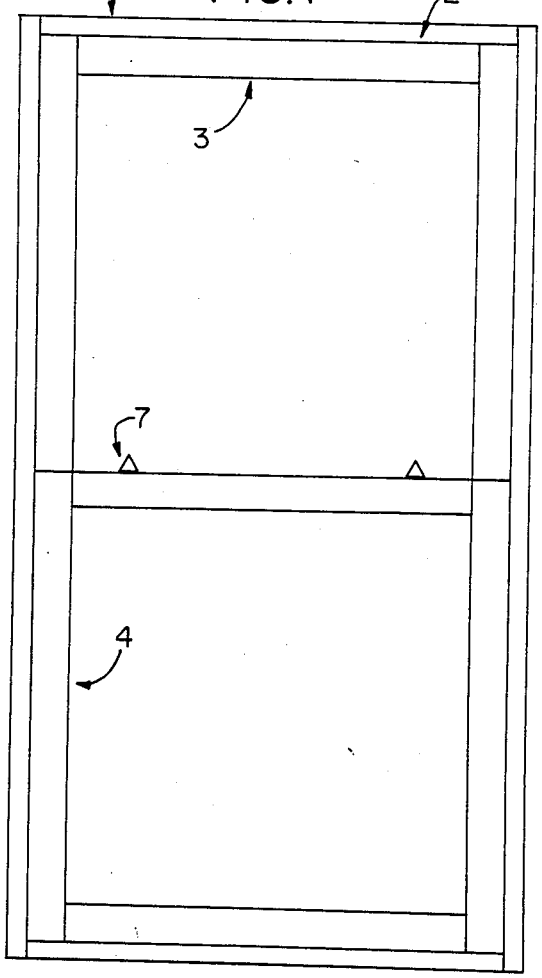
FIG. 1 is an interior view of a complete double-hung window constructed in accordance with the invention in the closed position.

Referring to the drawings, and first to FIGS. 1 and 2 thereof, therein is shown a "double-hung" window 1 made according to the present invention. The window 1 comprehends a window frame 2, an upper sash 3 and a lower sash 4. In the window 1 only the lower, or inner, sash 4 moves, and so, properly speaking, the window 1 is a single-hung window. The upper sash 3 is held to a blind stop (shown at 9 in FIG. 3) on the outside by screw plates or angles on the inside (not shown). A stop 5 (shown in FIG. 2) under the top (outer) sash 3 holds continuous weather seals 6 against which the bottom sash 4 presses when closed. When the window is closed, the lower sash 4 is locked in position by means of one or more conventional locks 7, each consisting of a rotatable clasp mounted on the inner sash 4 and a hook mounted on the outer sash 3. When the lock 7 is in the locked position, vertical movement of the sashes 3,4 is prevented. Moreover, in accordance with the present invention, locking the lock 7 provides a complete weather-tight seal in a manner to be described hereinafter. In FIG. 2, the lower sash 4 has been removed, and so the weatherstripping 6 in the stop 5 is shown. An important feature of the invention is the corner piece 8 (FIG. 4) which is mounted at each lower corner of the upper sash 3. By mounting the weatherstripping in the curved troughs of such corner pieces 8, the leakage which generally accompanies any split in the weatherstripping (such as occurs at joints) is avoided.

Figure 3:
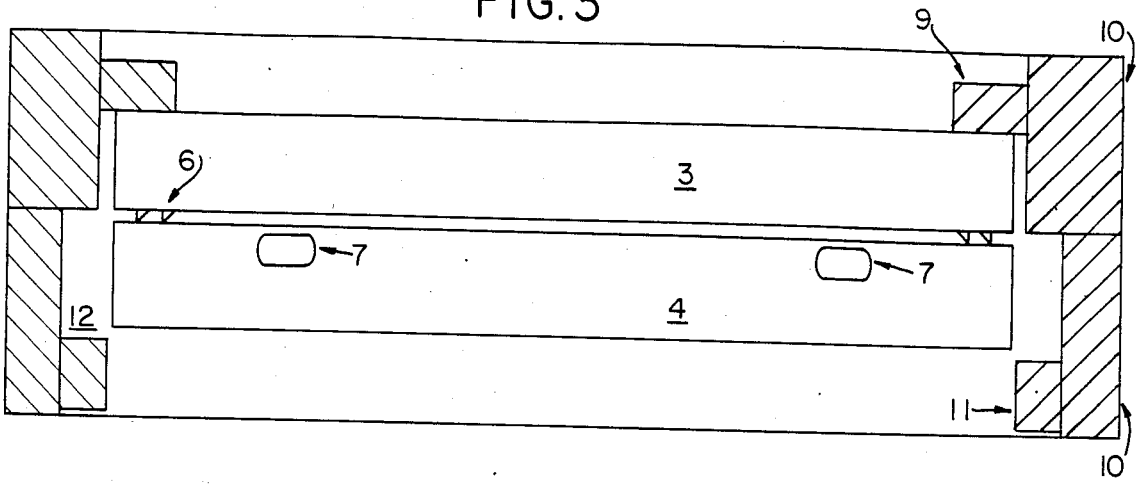
FIG. 3 is a top view of a cross section of the window of FIG. 1 on an enlarged scale.
Figure 4:
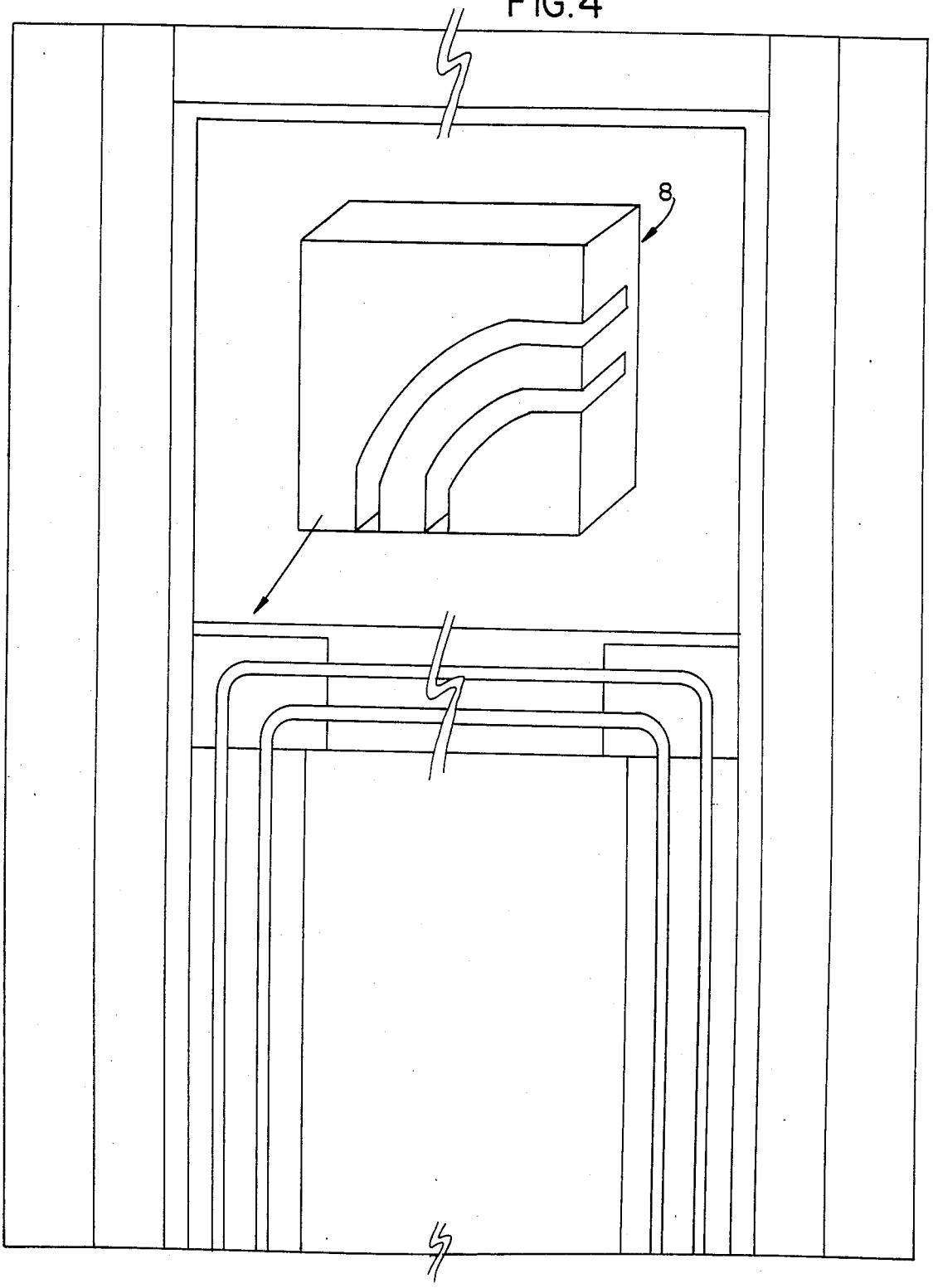
FIG. 4 is a close-up view of a corner piece which allows the continuous corner seal shown in FIG. 1.

Referring now to FIG. 3, the outside stop (blind) is shown at 9. The frame 2 includes side jambs 10. Interior stops 11 form, in conjunction with the side jambs 10, a space 12 for each of the two balance assemblies to be described hereinafter.

During the years after World War II, manufacturers of double-hung windows discarded the sash-weight balancing system previously used. In its place, they began to install several varieties of less expensive spring-loaded balances. One example of such a spring-loaded balance is a channel balance. In normal construction, such a channel balance has sheet-metal or vinyl tracks which are nailed to the side jambs of the window frame. Tabs protruding from the tracks hold the sashes up; the tabs, in turn, are supported by tension springs hidden behind the tracks.

The present invention makes use of a so-called block-and-tackle balance spring. Rather than having the balances a fixed part of a jamb liner, the balances are removably affixed to the lower sash. As the lower sash is lowered, the spring of the balance is extended. At a fixed location of the lower sash (for example at about 3 inches above its lowermost position), a bolt mounted in an attachment to the balance may be slid into a special receptacle in the interior stops, thereby fixing the spring of the balance in the extended position. This operation renders it safe to remove the lower sash from the balance and from the frame, so that both sides of the glass of the window may easily be cleaned.

Conventional sashes rely not only on the balance as a counter-weight but also relies on friction in part to support the sash and in part to reduce air leaks. In accordance with the invention the lower sash has complete freedom to move laterally, and air leaks are prevented by the provision of stripping comprehensively placed in the vertical plane. The lower sash of the invention is cammed laterally for a pressure seal. Thus the window of the invention eliminates the customary jamb liner, and the invention works a compression seal into the window. Thus the spring balance used in the invention must be a true balance and capable of supporting the weight of the lower sash. The key feature of the invention is the lateral movement of the lower sash to provide a compression seal. There is no track for the sash itself, nor is there a track for the balance supported on the lower sash. The sash moves between the exterior and interior stops (9,11).

Figures 5, 6, 7, 8, 9:
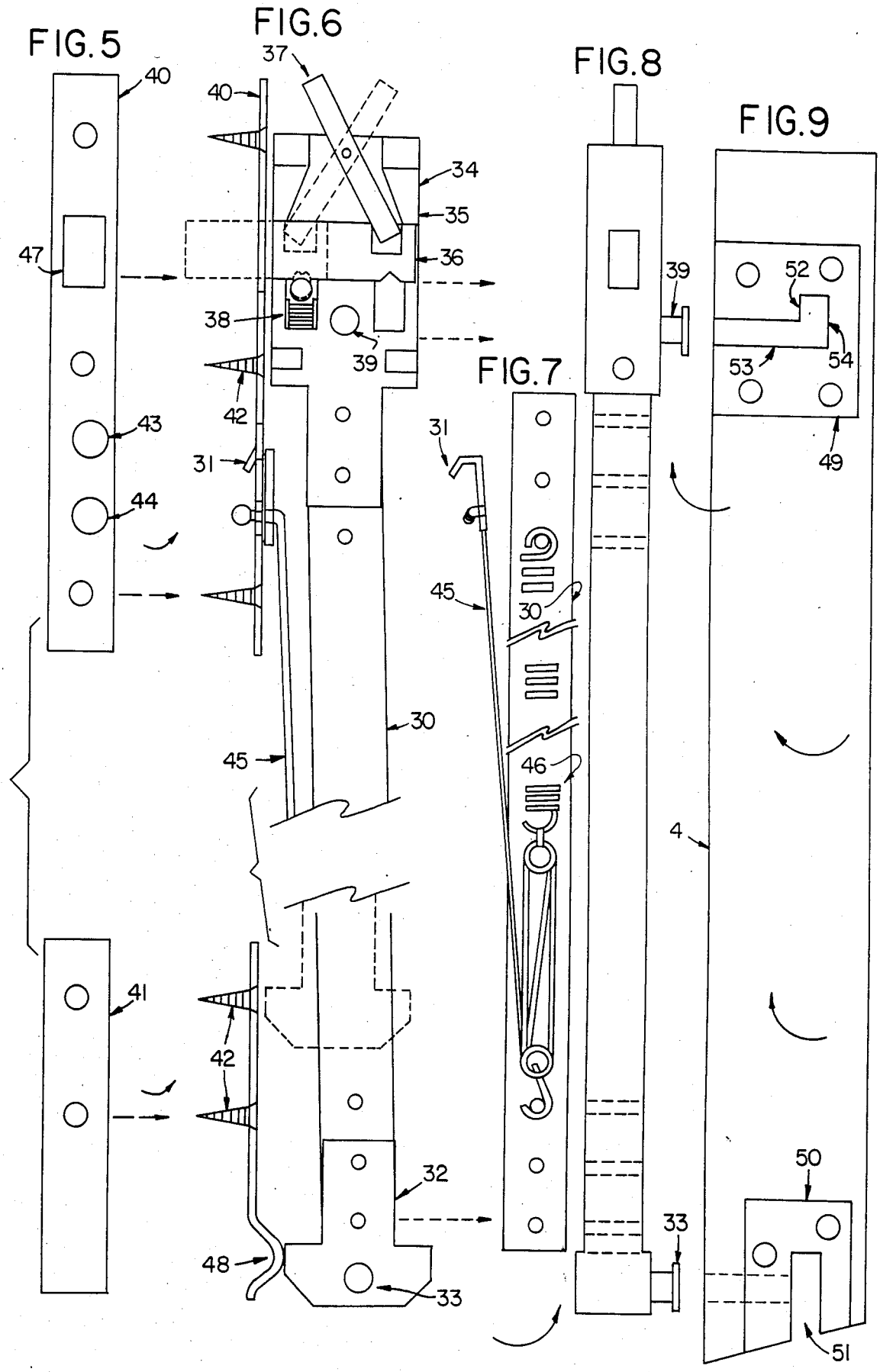
FIGS. 5 through 9 are a multi-view display showing the mechanisms for providing a very tight compression seal in accordance with the invention.

The details of the mechanisms associated with the balance are shown in FIGS. 5 through 9. FIG. 5 shows a receiver plate 40 and a bumper plate 41, which are affixed to the interior stop 11 (FIG. 3) within the space 12. FIG. 6 shows a block-and-tackle spring balance 30 mounted on the receiver plate 40 by means of a balance activating hook 31, all as viewed from the lower sash 4. (Consequently, in the transition from FIG. 5 to FIG. 6, the receiver plate 40 and the bumper plate 41 are effectively rotated 90 degrees, as indicated by the arrow.) FIG. 7 shows the interior mechanism of the balance 30 as viewed from the lower sash 4. FIG. 8 shows the balance 30 as viewed from the lower sash 4. FIG. 8 shows the balance 30 as viewed from the interior side of the window 1. (Consequently, in the transition from FIGS. 6 and 7 to FIG. 8, the balance 30 is effectively rotated 90 degrees, as indicated by the arrow.) FIG. 9 shows the lower sash 4 as viewed from the balance 30, upon which it is to be mounted.

Referring to FIGS. 5 through 9, the block and tackle spring balance 30 therein shown is of conventional design and has a balance-activating hook 31. In accordance with the invention, the balance 30 is modified by turning it 90 degrees from its normal use (as exemplified by the aforementioned U.S. Pat. No. 4,503,641 to Swan) and by having riveted thereto at the bottom end thereof a bottom balance shoe 32 having a bottom locating stud 33. In addition, riveted to the top end of the balance 30 is a top balance shoe 34. Said top balance shoe includes a housing 35, a sliding bolt 36, a lever 37, a spring and ball catch 38, and a top-locating stud 39.

Support for the balance 30 is provided by a receiver plate 40 of stainless steel. The receiver plate 40 and the bumper plate 41 are affixed to the interior stop 11 within the space 12 by screws 42. The receiver plate 40 includes a balance hook receiving aperture 43 and a hook connector relief aperture 44. The balance 30 is supported on the receiver plate 40 by virtue of the placement of the balance activating hook 31 in the balance hook receiving aperture 43. As in the conventional block and tackle spring balance, a cord 45 which forms part of the block and tackle is tied to an aperture in the balance hook 31 and the resultant knot or other member would press against the receiver plate 40 were it not for the provision of the hook connector relief aperture 44. During normal operation the balance 30 is connected to the lower sash 4 which maintains the spring 46 of the balance 30 under tension so that the balance hook 31 engages the balance hook receiving aperture 43, as described hereinafter. In order that the lower sash 4 may be readily removed, the receiver plate 40 also includes a bolt receiving slot 47. Prior to removal of the lower sash 4, the sliding bolt 36 is moved into the slot 47 by appropriate movement of the lever 37, and the spring and ball catch 38 grips the bolt 36 to hold it in position. In this position the balance 30 is affixed to the interior stop 11 by means of the bolt 36 and the balance hook 31.

The bumper plate 41 includes a bumper 48 against which the bottom balance shoe 32 presses when the lower sash 4 is closed, and the action of the bumper 48 is to move the bottom balance shoe 32 (and therefore also the sash 4) away from the interior stop 11 and towards the weather stripping 6.

The studs 33, 39 on the bottom and top balance shoes are provided in order that the lower sash 4 may be affixed to the balance 30. To this end, there are provided on the sides of the lower sash 4 a top sash shoe 49 and a bottom sash shoe 50. The bottom sash shoe 50 includes a simple vertical slot 51 adapted to engage the bottom locating stud 33. The top sash shoe 49 has an L-shaped slot 52 so that a horizontal portion 53 initially engages the top locating stud 39 and then the lower sash 4 slides downward slightly so that the top locating stud 39 engages the vertical portion 54 of the L-shaped slot 52.

During normal operation the balance 30 is connected to the lower sash 4 by means of said studs 33 and 39, and the lower sash maintains the spring 46 of the balance 30 under tension so that the balance hook 31 engages the balance hook receiving aperture 43. The balance, not the sash, travels in space 12 and carries the sash 4. In order that the lower sash 4 may be readily removed, the receiver plate 40 also includes a bolt receiving slot 47. Prior to removal of the lower sash 4, the sliding bolt 36 is moved into the slot 47 by appropriate movement of the lever 37, and the spring and ball catch 38 grips the bolt 36 to hold it in position. In this position the balance 30 is affixed to the interior stop 11 via the receiver plate 40 by means of the bolt 36 and the balance hook 31, rendering it stationary, and the lower sash 4 can be readily removed by appropriate movements which disengage slots 51 and 52 from studs 33 and 39, respectively.

Having thus described the principles of the invention, together with an illustrative embodiment thereof, it is to be understood that, although specific terms are employed, they are used in a generic and descriptive sense, and not for purposes of limitation, the scope of the invention being set forth in the following claims.

I claim:

1. A window assembly comprising a frame; an upper sash; a moveable sash assembly comprising a moveable lower sash having a first face facing said upper sash and a second face facing away from said first face, and a balance removably connected to said lower sash, said balance having means for gripping said frame, said gripping means facing away from said first face; a stop below said upper sash to support weatherstripping; continuous weatherstripping mounted in said stop; and means for moving said lower sash laterally against said weatherstripping to compress it only when the window is closed.

2. A window assembly according to claim 1, wherein said continuous weatherstripping also includes weatherstripping mounted in said upper sash.

3. A window assembly according to claim 1, wherein each said balance is a block-and-tackle spring balance.

4. A window assembly according to claim 3, wherein each said balance has associated therewith means including said gripping means for affixing said balance relative to said frame while the spring of said balance is under tension.

* * * * *